US006899793B2

(12) United States Patent
Nonomura et al.

(10) Patent No.: US 6,899,793 B2
(45) Date of Patent: May 31, 2005

(54) METHOD OF MANUFACTURING PULP MOLD FORMED BODY

(75) Inventors: Akira Nonomura, Tochigi (JP); Yasushi Yamada, Tochigi (JP); Tokuo Tsuura, Tochigi (JP); Hiroaki Kobayashi, Tochigi (JP); Kenichi Otani, Tochigi (JP)

(73) Assignee: Kao Corporation, Tokyo (JP)

( * ) Notice: Subject to any disclaimer, the term of this patent is extended or adjusted under 35 U.S.C. 154(b) by 212 days.

(21) Appl. No.: 10/182,743

(22) PCT Filed: Feb. 16, 2001

(86) PCT No.: PCT/JP01/01115

§ 371 (c)(1),
(2), (4) Date: Aug. 15, 2002

(87) PCT Pub. No.: WO01/61109

PCT Pub. Date: Aug. 23, 2001

(65) Prior Publication Data

US 2003/0010462 A1 Jan. 16, 2003

(30) Foreign Application Priority Data

Feb. 17, 2000 (JP) ..... 2000-39601

(51) Int. Cl.[7] ..... D21J 3/10; D21J 7/00

(52) U.S. Cl. ..... 162/218; 162/220; 162/221; 162/223; 162/224; 162/227; 162/230; 162/382; 162/401; 162/405

(58) Field of Search ..... 162/218, 220–224, 162/228–230, 387–416; 264/40.3, 40.5, 86, 87, 301, 306, 313, 315, 329; 229/5.5, 5.7, 406

(56) References Cited

U.S. PATENT DOCUMENTS 2,023,200 A * 12/1935 Huff et al. ..... 162/194
2,025,053 A * 12/1935 Heymann et al. ..... 162/218
2,026,171 A * 12/1935 Heymann ..... 229/235
2,961,043 A 11/1960 Hicks
3,250,668 A * 5/1966 Modersohn ..... 162/220
3,664,574 A * 5/1972 Pearl ..... 206/521.1
5,283,027 A * 2/1994 Sakamoto et al. ..... 264/320
6,454,906 B1 9/2002 Nonomura et al.
6,461,480 B1 10/2002 Otakura et al.
6,468,398 B1 10/2002 Kumamoto et al.

FOREIGN PATENT DOCUMENTS

| | | | |
|---|---|---|---|
| JP | 27-3306 | 8/1952 | |
| JP | 35-9669 | 7/1960 | |
| JP | 47-1565 | 1/1972 | |
| JP | 7-223230 | 8/1995 | |
| JP | 11-314257 | 11/1999 | |
| JP | 2000-84959 | * 3/2000 | ..... B29C/41/12 |
| JP | 2000-309322 | 11/2000 | |

OTHER PUBLICATIONS

U.S. Appl. No. 09/622,043, Oct. 10, 2000, pending.

U.S. Appl. No. 09/673,667, Jan. 5, 2001, pending.

U.S. Appl. No. 09/885,982, Jun. 22, 2001, allowed.

(Continued)

*Primary Examiner*—Eric Hug
(74) *Attorney, Agent, or Firm*—Oblon, Spivak, McClelland, Maier & Neustadt, P.C.

(57) ABSTRACT

A method of producing a pulp molded article. The method feeds a pulp slurry to a cavity of a papermaking mold having a prescribed cavity shape to form a pulp preform including a main part having an opening and a separable part having a flange and connected to an edge of the opening. A pressing member is inserted into the preform, the pressing member is expanded to press the preform toward the papermaking surface, the preform is removed from the papermaking mold, and then the preform is cut at a joint between the separable part and the main part.

11 Claims, 4 Drawing Sheets

OTHER PUBLICATIONS

U.S. Appl. No. 09/868,040, Jul. 23, 2001, pending.
U.S. Appl. No. 10/204,859, Aug. 26, 2002, pending.
U.S. Appl. No. 10/182,743, Aug. 15, 2002, pending.
U.S. Appl. No. 10/182,743, Aug. 15, 2002, Nonomura et al.
U.S. Appl. No. 10/365,453, Feb. 13, 2003, Kumamoto et al.
U.S. Appl. No. 09/508,540, Apr. 7, 2000, Otsuji et al.
U.S. Appl. No. 09/713,230, Nov. 16, 2000, Nonomura et al.
U.S. Appl. No. 09/889,566, Aug. 9, 2001, Nonomura.
U.S. Appl. No. 09/926,690, Dec. 3, 2001, Otani et al.
U.S. Appl. No. 10/110,715, Apr. 15, 2002, Tojo et al.
U.S. Appl. No. 10/212,723, Aug. 7, 2002, Kumamoto et al.
U.S. Appl. No. 10/335,153, Jan. 2, 2003, Kumamoto et al.

* cited by examiner

Present Invention (a)

METHOD OF MANUFACTURING PULP MOLD FORMED BODY

TECHNICAL FIELD

The present invention relates to a method of producing a pulp molded article.

BACKGROUND ART

Production of pulp molded articles includes the step of dewatering a water-containing preform as obtained by a papermaking operation for the purpose of, for example, improving handling properties and shortening the drying time. A known dewatering method comprises interposing the preform between an outer mold of which the inner shape is substantially the same as the contour of a molded article to be produced and an inner mold having a flexible film which expands into a shape substantially the same as the inner shape of the molded article and pressing and dewatering the preform by making use of the expansion of the flexible film as described in JP-A-7-223230.

In the above method, if the water-containing preform is out of the right position when pressed between the outer mold and the inner mold, or if the preform has an uneven thickness, it could follow that the preform, being fragile, is deformed or undergoes damages such as fall-off of the pulp fibers making up itself due to missregistered contact with the molds.

DISCLOSURE OF THE INVENTION

Accordingly, an object of the present invention is to provide a method of stably producing a pulp molded article in which a water-containing pulp preform can be press-dewatered or press-dried without being deformed or damaged.

The present invention accomplishes the above object by providing a method of producing a pulp molded article comprising the steps of:

feeding a pulp slurry to a cavity of a papermaking mold having a prescribed cavity shape to form a pulp preform on a papermaking surface of said cavity in such a manner that said preform comprises a main part having an opening and a separable part having a flange and connected to the edge of said opening, feeding a pressurizing fluid into said preform to dewater said preform, removing said preform from said papermaking mold, putting said preform into a cavity of a heating mold having a prescribed cavity shape, inserting an expandable pressing member into said preform, feeding a prescribed fluid into said pressing member to expand said pressing member thereby to dry said preform while pressing said preform by the expanded pressing member toward said papermaking surface, removing the dried preform from said heating mold, and then cutting said preform at a joint between said separable part and said main part (hereinafter referred to as a first aspect of the invention).

The present invention also accomplishes the above object by providing a method of producing a pulp molded article comprising the steps of:

feeding a pulp slurry to a cavity of a papermaking mold having a prescribed cavity shape to form a pulp preform on a papermaking surface of said cavity in such a manner that said preform comprises a main part having an opening and a separable part having a flange and connected to the edge of said opening, inserting an expandable pressing member into said preform, feeding a prescribed fluid into said pressing member to expand said pressing member thereby to press said preform toward said papermaking surface by the expanded pressing member, removing said preform from said papermaking mold, and then cutting said preform at a joint between said separable part and said main part (hereinafter referred to as a second aspect of the invention).

The present invention also provides a method of producing a pulp molded article comprising the steps of:

forming a preform having a prescribed shape by a wet papermaking process, putting said preform into a cavity of a heating mold having a prescribed cavity shape, inserting an expandable pressing member into said preform, feeding a prescribed fluid into said pressing member to expand said pressing member thereby to press said preform by the expanded preform toward a surface of said cavity to shape said preform into a main part having an opening and a separable part having a flange and connected to the edge of said opening, removing the resulting preform comprising said main part and said separable part from said heating mold, and then cutting said preform at a joint between said separable part and said main part (hereinafter referred to as a third aspect of the invention).

The present invention further provides an apparatus for producing a pulp molded article comprising:

a papermaking mold having a cavity of a prescribed shape, means for feeding a pulp slurry to said cavity, an expandable pressing member which is to be inserted into a pulp preform formed in said cavity and comprising a main part having an opening and a separable part having a flange and connected to the edge of said opening, means for inserting said pressing member, means for feeding a prescribed fluid into said pressing member, means for removing said preform from said papermaking mold, and means for cutting said preform at a joint between said separable part and said main part.

The present invention further provides another apparatus for producing a pulp molded article comprising:

a heating mold having a cavity of a prescribed shape, means for putting a pulp preform into said heating mold, said pulp preform having been formed by a wet papermaking process and comprising a main part having an opening and a separable part having a flange and connected to the edge of said opening, an expandable pressing member which is to be inserted into said preform, means for inserting said pressing member, means for feeding a prescribed fluid into said pressing member, means for removing said preform from said heating mold, and means for cutting said preform at a joint between said separable part and said main part.

BRIEF DESCRIPTION OF THE DRAWINGS

FIG. 1(*b*) shows the step of dewatering by feeding a pressurizing fluid. FIG. 1(*c*) shows the step of opening the papermaking mold.

FIG. 2(*b*) shows the step of heat drying. FIG. 2(*c*) shows the step of opening the heating mold. FIG. 2(*d*) shows the step of cutting the dried preform.

FIG. 4(*b*) shows the step of inserting a pressing member. FIG. 4(*c*) shows the step of dewatering by pressing. FIG. 4(*d*) shows the step of opening the papermaking mold.

BEST MODE FOR CARRYING OUT THE INVENTION

Figure 1A:
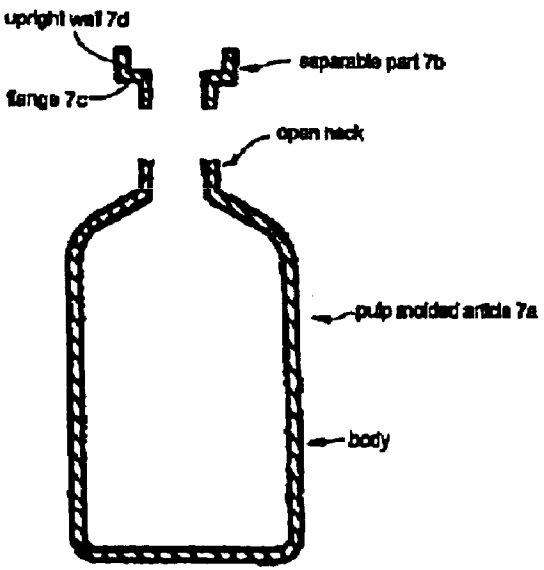
FIG. 1(*a*) shows the steps of feeding a pulp slurry and dewatering by suction.
Figure 1B:
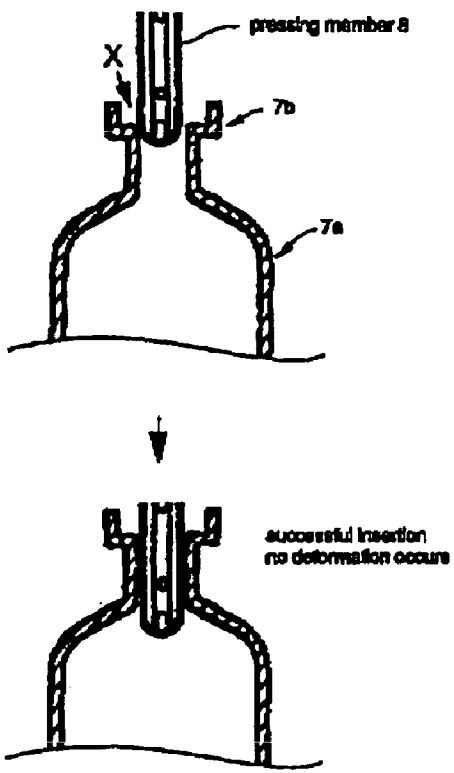
Figure 1C:
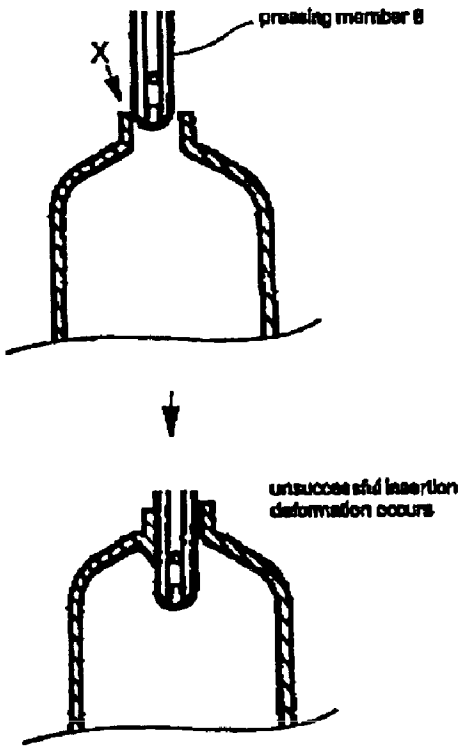
FIG. 1C Prior Art

The first aspect of the invention will be described based on its preferred embodiments with reference to the drawings. The present embodiment represents production of a bottle-shaped pulp molded article (hereinafter also referred simply to as is a molded article) with an open neck, of which the body has a larger diameter than the neck. FIGS. 1(*a*) through 1(*c*) depict in order the steps of papermaking and dewatering according to the pulp molded article production method of the present invention. FIG. 1(*a*) is the steps of feeding a pulp slurry and dewatering by suction; FIG. 1(*b*) is the step of dewatering by feeding a pressurizing fluid; and FIG. 1(*c*) is the step of opening the papermaking mold.

A production apparatus used to carry out the production method according to this embodiment comprises a papermaking mold having a cavity of a prescribed shape, a means for feeding a pulp slurry into the cavity, and a means for feeding a pressurizing fluid into a preform formed in the cavity.

A papermaking mold 1 shown in FIG. 1(*a*) is prepared. The papermaking mold 1 is made up of a pair of split pieces 2 and 3, the pieces 2 and 3 being joined together to form a cavity 4 having a prescribed shape. The inner wall of the cavity 4 is covered with a papermaking net (not shown) having a prescribed mesh size. Each of the pieces 2 and 3 has a plurality of interconnecting passageways 5 which connect the inside (the inner wall of the cavity 4) to the outside of the mold. Each interconnecting passageway 5 is connected to a suction means (not shown) such as a suction pump. The cavity 4 connects to the outside of the papermaking mold 1 through a slurry feed passage 6.

The cavity 4 is composed of a cavity part 4*a* corresponding to the main part of a pulp molded article with an opening and a cavity part 4*b* corresponding to a separable part connected to the edge of the opening of the main part. The cavity part 4*a* (corresponding to the main part) is shaped to provide a bottle-shaped pulp molded article having an open neck, a body, and a bottom. The cavity part 4*b* (corresponding to the separable part) is shaped to provide a separable part 7 having a laterally extending flange 7*c* and an upright wall 7*d* standing up from the periphery of the flange 7*c*. A ridge 11 is formed as a boundary between the cavity part 4*a* and the cavity part 4*b*. The ridge 11 is annular around the whole inner circumference of the cavity 4. The ridge 11 has a triangular cross-section.

With this state of the split mold 1, a feed nozzle 12 is inserted through the slurry feed passage 6, and a predetermined amount of a pulp slurry is poured into the cavity 4 through the feed nozzle 12. At the same time, the cavity 4 is evacuated by suction through the interconnecting passageways 5 toward the outside of the papermaking mold 1, whereby the water content of the pulp slurry is sucked up, and pulp fiber is built up on the papermaking surface, i.e., the papermaking net covering the inner wall of the cavity 4. As a result, there is formed a water-containing preform 7 as a deposit of pulp fiber on the papermaking net. A predetermined amount of water (diluent water) can be injected into the cavity 4 in the initial stage and/or the final stage of forming the preform 7 to thin the pulp slurry in the cavity 4 so as to prevent thickness unevenness of the preform 7 effectively. The initial stage of forming is the stage when the amount of pulp having been fed into the cavity 4 is not more than 30%, particularly not more than 20%, of the total amount of pulp necessary for preform formation. The final stage of forming is the stage when the amount of pulp having been fed into the cavity 4 is 70% or more, particularly 80% or more, of the total amount of pulp necessary for preform formation. The amount of diluent water to be fed is preferably such that the concentration of the pulp slurry is reduced to 80% or lower, particularly 20 to 60%.

As shown in FIG. 1(*a*), the preform 7 is composed of a main part 7*a* with an opening and a separable part 7*b* connected to the edge of the opening. An annular recess 13 corresponding to the ridge 11 on the inner wall of the cavity 4 of the papermaking mold 1 is formed at the joint between the main part 7*a* and the separable part 7*b*. The recess 13 is used for registration in cutting the main part 7*a* and the separable part 7*b* apart.

The feed nozzle 12 is used as a means for feeding the pulp slurry and a pressurizing fluid described later. The feed nozzle 12 has a fitting plate 12*a*, a nozzle 12*b* vertically piercing the fitting plate, a three-way valve 12*c* attached to the upper end of the nozzle 12*b*, and a slurry feed pipe 12*d* and a pressurizing fluid feed pipe 12*e* both connected to the three-way valve 12*c*. On switching the three-way valve 12*c*, the nozzle 12*b* is connected to either the slurry feed pipe 12*d* or the pressurizing fluid feed pipe 12*e*. While the pulp slurry is poured into the cavity 4, the nozzle 12*b* is connected to the slurry feed pipe 12*d*. The fitting plate 12*a* is fitted into the slurry feed passage 6 to close the slurry feed passage 6.

Molding of the preform 7 is performed such that the main part 7*a*, one part of the preform 7, has a bottle shape having an open neck, a body, and a bottom and that the separable part 7*b*, the other part of the preform 7, has a laterally extending flange 7*c* and an upright wall 7*d* standing up from the periphery of the flange 7*c*.

The resulting preform 7 is subjected to a dewatering step. As shown in FIG. 1(*b*), the papermaking mold 1 is evacuated through the interconnecting passageways 5. In this state, with the feed nozzle 12 remaining fixed at the position for papermaking, the three-way valve 12*c* is switched over to connect the nozzle 12*b* to the pressurizing fluid feed pipe 12*d*, and a prescribed pressurizing fluid is supplied from a pressurizing fluid source (not shown) to the cavity 4. As stated previously, since the slurry feed passage 6 is clogged by the fitting plate 12*a*, the cavity 4 is hermetic. The term "hermetic" as used herein does not mean that the cavity 4 is completely hermetic but that the cavity 4 is airtight enough to increase its inner pressure above a specific level described later by introducing a pressurizing fluid. The introduced pressurizing fluid penetrates the preform 7 and is discharged outside through the interconnecting passageways 5.

Pressurizing fluids which can be used include steam and superheated steam (hereinafter inclusively referred to as steam). It is particularly preferred to use superheated steam. By blowing steam, the temperature of water present in the preform 7 rises instantaneously by the heat transfer in condensation of steam thereby to reduce the viscosity and the surface tension of water. As a result, the water content in the preform 7 is blown off instantaneously and very efficiently thereby achieving improved dewatering efficiency. Not relying chiefly on heat exchange, this dewatering technique is extremely energically advantageous. Moreover dewatering completes instantaneously, providing a reduction of dewatering time. Because an elastic pressing member, which is used in the heat drying step hereinafter described, is not used for dewatering, the time for mechanical operations involved in using a pressing member, such as insertion into the cavity, is omitted, resulting in a reduction of the time for mechanical operations. Further, because the blowing pressure is lower than the pressure applied in press dewatering, there is obtained an additional advantage that the papermaking net hardly leaves its marks on the surface of the resulting preform 7 to provide a molded article with a good appearance.

Steam are preferably introduced to increase the inner pressure of the cavity 4 to 98 kPa or greater, particularly 196 kPa or greater, especially 294 kPa or greater. While better results are obtained with a higher inner pressure of the cavity 4, the upper limit of the pressure that pays is about 980 kPa because the water removal efficiency gradually approaches saturation with a pressure increase. The term "(inner) pressure in the cavity 4" as used herein means a steam pressure difference between the inlet and the outlet of the cavity 4.

It is preferable to start introducing steam while the slurry stays in the cavity 4 or while the diluent water, which has been fed into the cavity 4 in the final stage of forming the preform 7, stays in the cavity 4, whereby the water content in the cavity 4 is expelled out of the mold to shorten the dewatering time. Steam is preferably blown for about 2 to 20 seconds, particularly about 3 to 15 seconds. Dewatering completes in an extremely short time. By this dewatering step, the preform that has had a water content of 75 to 80% by weight before dewatering is dewatered to a water content of about 40 to 70% by weight.

Where superheated steam is used, a sufficient degree of superheating is such that the inner pressure of the mold is increased to or above the above-specified value and that the steam is not condensed before being blown into the mold. Steam may be overheated sufficiently, but the dewatering effect is not improved correspondingly.

In addition to the above-mentioned steam, compressed air is also useful as a pressurizing fluid for dewatering the preform 7. By blowing compressed air, a physical mechanism which does not chiefly rely on heat exchange works to remove the water content from the wet preform 7 instantaneously. Compressed air is preferably blown to increase the pressure of the cavity 4 to 196 kPa or higher, particularly 294 kPa or higher. The upper limit of the pressure is about 1471 kPa for the same reasons as with steam. The time for blowing compressed air is preferably 10 to 60 seconds, particularly 15 to 40 seconds. The pressure (initial pressure) of compressed air is not particularly limited as long as the mold inner pressure may be increased to or above the above-recited level. The detailed description concerning steam appropriately applies to the particulars of compressed air that are not described here.

While steam and compressed air may be used individually, a combined use of both is preferred for dewatering efficiency. It is particularly preferred to introduce steam followed by compressed air for the following reason. If the steam blowing time is long, there can result a large water content variation in the vertical direction of the preform 7. In order to avoid this, it is effective to first blow steam to sufficiently elevate the temperature of water contained in the preform and then blow compressed air. When steam and compressed air are blown in this order, steam are preferably blown at a pressure of 98 kPa or higher, particularly 196 kPa or higher, especially 294 kPa or higher, for 2 to 20 seconds, particularly 3 to 15 seconds, and compressed air is preferably blown at a pressure of 196 kPa or higher, particularly 294 kPa or higher, for 2 to 25 seconds, particularly 5 to 20 seconds. It is preferred for dewatering efficiency that blowing steam be continuously followed by blowing compressed air.

After the preform 7 is dewatered to a prescribed water content, the feed of the pressurizing fluid is stopped, and the feed nozzle 12 is taken out of the papermaking mold 1 as shown in FIG. 1(*c*). The papermaking mold 1 is opened, and the preform 7 having been dewatered to the prescribed water content is removed by means of a prescribed handling unit.

The preform 7 taken out is then subjected to the step of heat drying. FIGS. 2(*a*) to 2(*c*) show the heat drying step in order. FIG. 2(*a*) is the step of inserting a pressing member; FIG. 2(*b*) the step of heat drying; FIG. 2(*c*) the step of opening the heating mold; and FIG. 2(*d*) the step of cutting the dried preform.

The heat drying step is carried out by use of a production apparatus comprising a heating mold having a cavity of a prescribed shape, a means for fitting the pulp preform formed in the papermaking mold 1 into the heating mold, an expandable pressing member which is to be inserted into the preform 7, a means for inserting the pressing member, a means for feeding a prescribed fluid into the pressing member, a means for removing the preform 7 from the heating mold, and a means for cutting the preform 7 at the joint between the separable part 7*b* and the main part 7*a*.

A heating mold 21 which is made up of a pair of split pieces 22 and 23 is separately prepared, the pieces 22 and 23 being joined together to form a cavity 24 having a shape in conformity to the contour of a molded preform to be produced. The heating mold 21 is previously heated to a prescribed temperature. In this embodiment, the cavity shape of the heating mold 21 is the same as that of the papermaking mold. Therefore, a ridge 27 is formed on the cavity wall of the heating mold 21 at the position corresponding to the joint between the separable part 7*b* and the main part 7*a* of the preform similarly to the papermaking mold 1. The water-containing preform having been dewatered to the prescribed water content is fitted into the cavity of the heated heating mold by means of a prescribed handling unit. There is not a net on the inner surface of the cavity 24. Each of the split pieces 22 and 23 has a plurality of interconnecting passageways 25 which connect the inside thereof (the inner wall of the cavity 24) and the outside. Each interconnecting passageway 25 is connected to a suction means (not shown), such as a suction pump. The cavity 24 connects to the outside of the heating mold 21 through a pressing member insertion passage 26.

While the heating mold 21 is sucked from the inside toward the outside through the interconnecting passageways 25, a pressing member 8, which is a hollow bag, is inserted into the preform 7 through the pressing member insertion passage 26 as shown in FIG. 2(*a*). The pressing member 8 is used to press and dry the preform 7.

When the pressing member 8 is accidentally inserted into the preform 7 at an inaccurate position and goes down toward the bottom of the preform 7 while touching the pulp fibers of the separable part 7*b*, the flange 7*c* behaves an anchor on the pulp fibers which go down toward the bottom of the preform 7*c*. The pulp fibers touched by the pressing member 8 still stay at the original position of the separable part 7*b*. As a result, the main part 7*a* has no defect arising from the pulp fibers touched by the pressing member 8 because the separable part 7*b* is an unnecessary part once the main part 7*a* is obtained. The anchor effect of the flange 7*c* is more enhanced by the presence of the upright wall 7*d* formed on the periphery of the flange 7*c*.

The separable part 7*b* also has an advantage in making a multilayered molded article. In the production of the multilayered molded article, two or more slurries are employed. In general, undesirable mixing of the slurries tends to occur near the end of an open neck of the preform 7. The mixing of the slurries jeopardizes the formation of a clear multilayered structure. In the present invention, the separable part 7*b* occupies the end of the open neck. Therefore, even if the separable part 7*b* does not have a clear multilayered structure, the main part 7*a* may be highly likely to have a clear multilayered structure. The separable part 7*b* is unnecessary once the target molded article is obtained. As a result, the production yield of the multilayered molded article is improved by the presence of the separable part 7*b*.

The separable part 7*b* provides an additional advantage in the production of the pulp molded article. The separable part is useful as a handle to be gripped by a handling unit which transfers the preform 7 to a next production step of the molded article.

The pressing member 8 has a supporting member 10 inserted therein. The supporting member 10 is a cylinderical pipe having many holes 10*a* in its lateral surface. The lower end 10*b* of the supporting member 10 is open. The pressing member 8 has a projection 8*b* of a prescribed shape on the inner side of its bottom, and the projection 8*b* is fitted into the lower open end 10*b*. The pressing member is inserted into the preform 7 with the supporting member 10. The insertion of the pressing member 8 into the preform 7 may be smooth because the supporting member 10 functions as a spine of the pressing member 8. The supporting member 8 can prevent a swaying motion of the pressing member 8 during the insertion process. Further, expansion of the pressing member 8 hereinafter described can be performed uniformly, and the preform 7 can be press dried uniformly.

As shown in FIG. 2(*a*), the pressing member 8 and the supporting member 10 are inserted into the preform 7 in a state fixed to a fixing part 9 as a means for inserting the pressing member 8. FIG. 3 minutely illustrates the structure of the fixing part 9.

As shown in FIG. 3, the fixing part 9 is made of a fitting plate 9*a*, a pressing bush 9*b*, and a holder 9*c*.

The fitting plate 9*a* is a flat plate having a through-hole in its center. The diameter of the through-hole is approximately the same as that of the supporting member 10. The supporting member 10 is inserted through the through-hole and fixed therein. The inner wall of the through-hole has an annular groove, in which an O-ring 9*d* is fitted to keep air-tightness between the through-hole and the supporting member.

The pressing bush 9*b* is a cylinder having a flange 9*e* extending laterally from the upper end. The upper open end of the hollow bag pressing member 8 is clamped between the upper face of the flange 9*e* and the lower face of the fitting plate 9*a*.

The holder 9*c* is fixed to the fitting plate 9*a* by fixing screws 9*f* thereby to hold the flange 9*e* of the pressing bush 9*b*.

The pressing member 8 is made of an expandable material. The term "expandable" as used herein for the pressing member means that (1) the pressing member 8 elastically stretches and contracts to change its capacity or (2) the pressing member 8 is not stretchable per se but is capable of changing its capacity with a fluid fed inside thereof or discharged outside. The former expandable member is made of an elastic material, such as natural rubber, urethane rubber, fluororubber, silicone rubber and elastomers. The latter expandable member can be of flexible materials, such as plastic materials (e.g., polyethylene and polypropylene), films of such plastic materials having aluminum or silica deposited thereon, films of such plastic materials laminated with aluminum foil, papers, fabrics, and the like. In the present embodiment, a balloon-like oblong bag made of an inflatable elastic material is used as a pressing member 8.

As shown in FIG. 2(*b*), when the pressing member 8 is completely inserted, the lower end of the pressing member 8 is positioned near the bottom of the preform 7. In this state, a prescribed pressurizing fluid is fed into the supporting member 10 from its source (not shown), i.e., a feeder of the pressurizing fluid, as shown in the Figure. The pressurizing fluid fed is supplied inside the pressing member 8 through the holes 10*a* made on the lateral surface of the supporting member 10. Simultaneously with the pressurizing fluid feed, the split pieces 22 and 23 are sucked from the outside. The pressing member 8 is thus inflated.

The preform 7 is pressed by the inflated pressing member 8 toward the inner surface of the cavity 24, whereby the preform 7 dries, and the inner configuration of the cavity 24 is transferred to the preform 7 at the same time. Since the preform 7 is pressed from its inside to the inner wall of the cavity 24, the shape of the cavity 24 can be transferred to the preform 7 with high precision however complicated it may be, and a deep molded article having an almost upright body can be produced easily. The pressurizing fluid which can be used to expand the pressing member 8 includes air (pressurizing air), hot air (heated pressurizing air), superheated steam, oil (heated oil), and other various liquids. From the standpoint of operating convenience, it is preferable to use air, hot air or superheated steam. The pressurizing fluid is preferably fed under a pressure of 0.01 to 5 MPa, particularly 0.1 to 3 MPa.

Figures 2A, 2B, 2C, 2D:
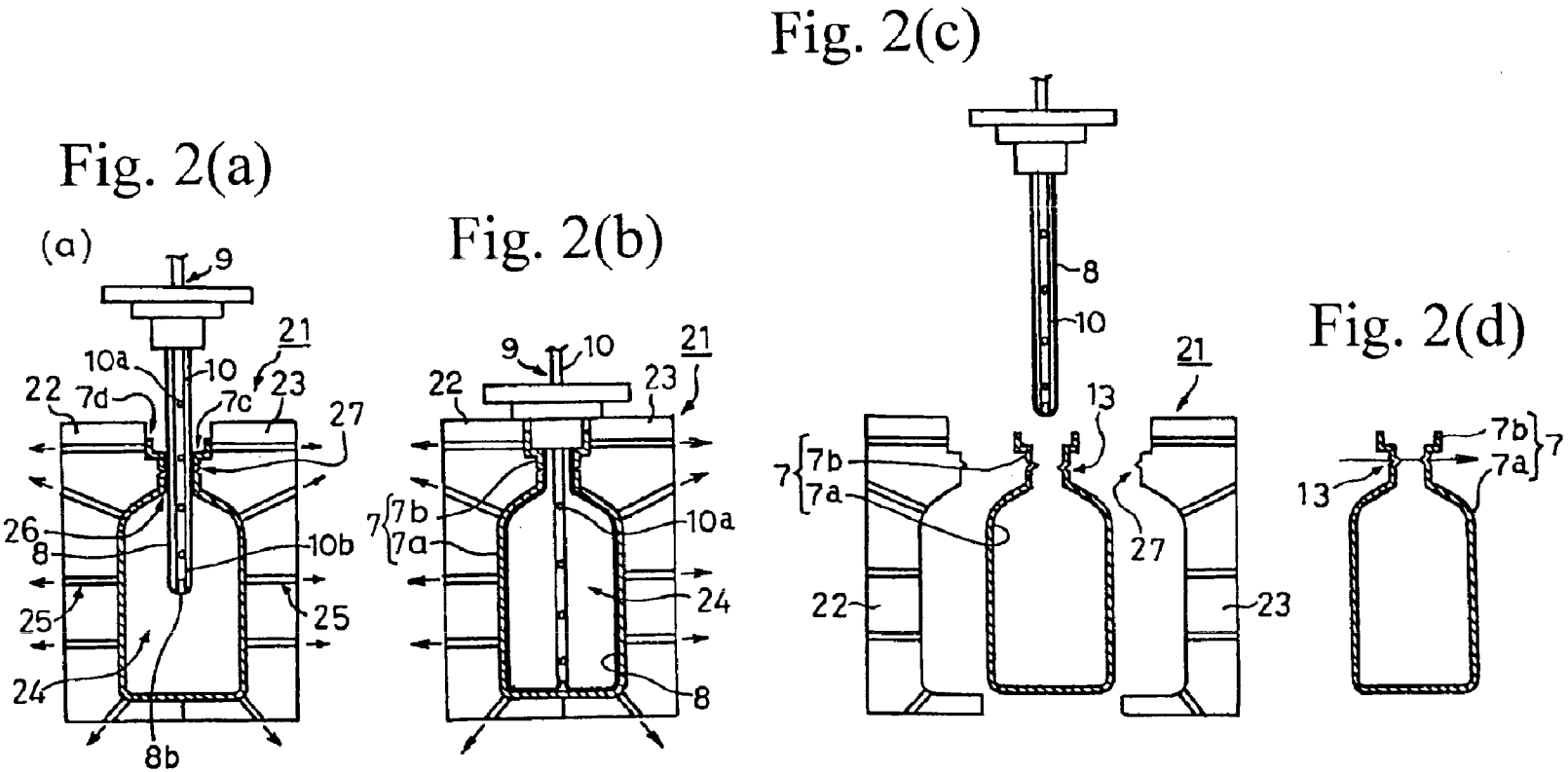
FIG. 2(*a*) shows the step of inserting a pressing member.
Figure 3:
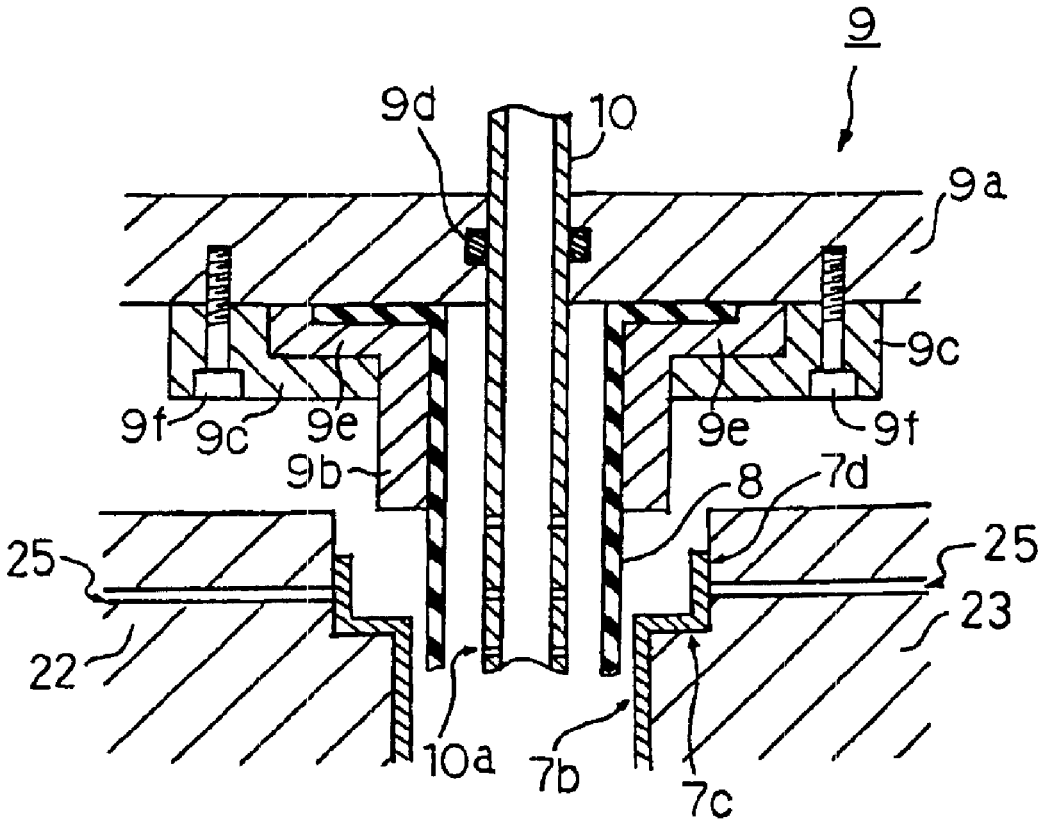
FIG. 3 minutely shows the fixing part.

After the preform has dried sufficiently, the fluid is withdrawn from the pressing member 8, whereby the pressing member 8 shrinks to its original size as shown in FIG. 2(C). The shrunken pressing member 8 and the supporting member 10 are then removed from the molded article 7, and the heating mold 21 is opened to take out the molded article by means of a prescribed handling unit.

As shown in FIG. 2(*d*), the molded article 7 taken out of the heating mold is cut with a prescribed cutting means at the joint connecting the separable part 7*b* and the main part 7*a* into the separable part 7*b* and the main part 7*a*. There is thus obtained a pulp molded article 7*a* as a final product. A rotary knife can be used, for example, as a cutting means. Since the joint has the annular recess 13 corresponding to the ridge 11 of the papermaking mold 1 as described previously, it is easy to position a rotary knife in cutting thereby reducing occurrence of reject articles. The separable parts 7*b* that have been cut off are reused as a material of molded articles.

Figures 4A, 4B, 4C, 4D:
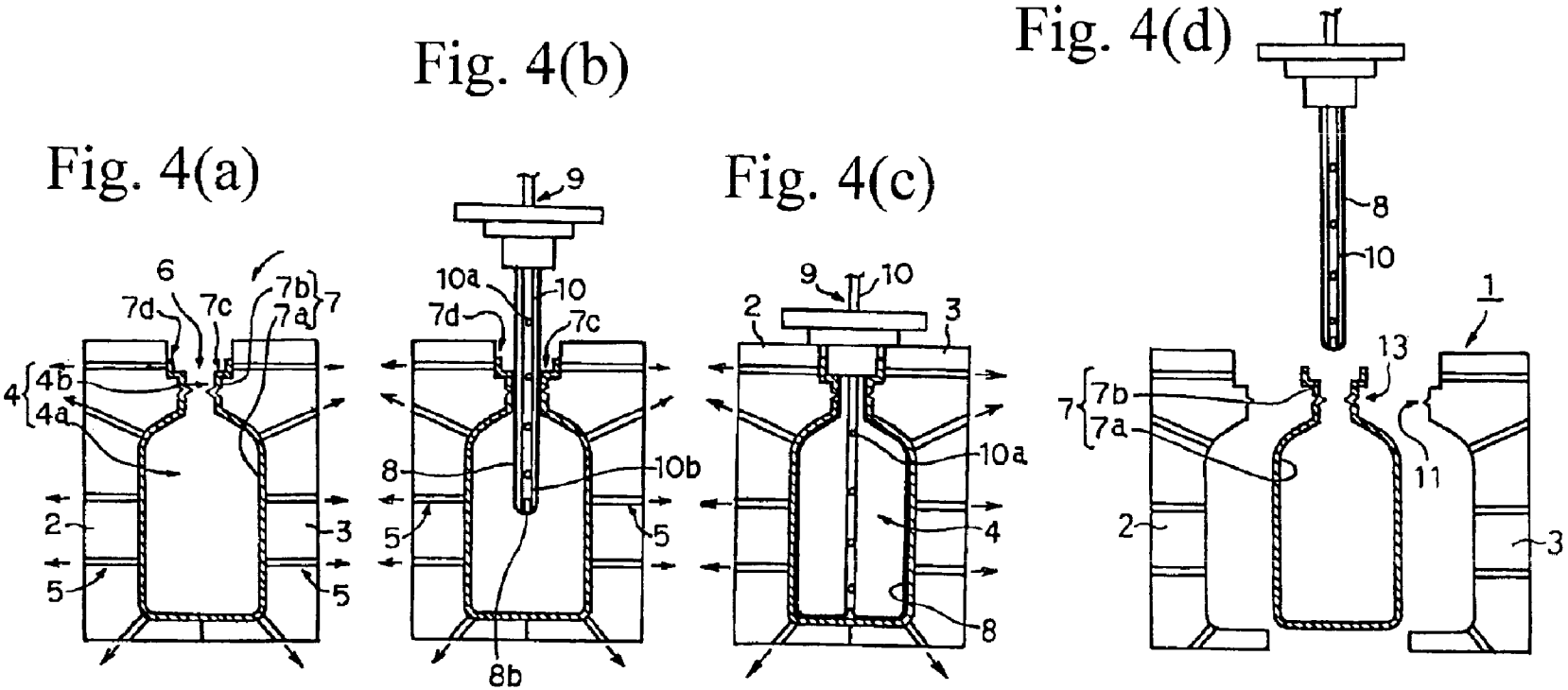
FIG. 4(*a*) shows the steps of feeding a pulp slurry and dewatering by suction.

The second aspect of the invention is described based on its preferred embodiments with reference to FIGS. 4(*a*) through 4(*d*). The second aspect of the invention will be described only with regard to differences from the first one. The detailed description about the first aspect appropriately applies to the particulars of the second aspect that are not described here. The members in FIGS. 4(*a*) to 4(*d*) that are the same as those in FIGS. 1 to 3 are given the same reference numerals as in the latter. The particular embodiment described here represents production of a bottle-shaped molded article with an open neck, of which the body has a larger diameter than the neck similarly to the first aspect of the invention. FIGS. 4(*a*) through 4(*d*) depict in order the steps of papermaking and dewatering according to the pulp molded article production method of the present invention. FIG. 4(*a*) is the steps of pouring a pulp slurry and dewatering by suction; FIG. 4(*b*) is the step of inserting a pressing member; FIG. 4(*c*) is the step of press dewatering; and FIG. 4(*d*) is the step of opening the papermaking mold.

An apparatus which can be used to carry out the production method of the present embodiment comprises a papermaking mold having a cavity of a prescribed shape, a means for feeding a pulp slurry to the cavity, an expandable pressing member which is to be inserted into a preform formed in the cavity, a means for inserting the pressing member, a means for feeding a prescribed fluid into the pressing member, and a means for removing the molded article from the papermaking mold.

As shown in FIG. 4(*a*), a predetermined amount of a pulp slurry is poured into the cavity 4 of the papermaking mold 1 through the slurry feed passage 6 by a pulp slurry feeding means (not shown). At the same time, the cavity 4 is evacuated by suction through the interconnecting passageways 5 toward the outside of the papermaking mold 1, whereby the water content of the pulp slurry is sucked up, and pulp fiber is built up on the papermaking surface, i.e., the papermaking net covering the inner wall of the cavity 4. As a result, there is formed on the papermaking net a water-containing preform 7 composed of a main part 7*a* with an opening and a separable part 7*b* connected to the edge of the opening. Similarly to the first aspect of the invention, a predetermined amount of diluent water may be injected into the cavity 4 in the initial stage and/or the final stage of forming the preform 7 to thin the pulp slurry in the cavity 4.

The resulting preform 7 is subjected to a press-dewatering step. As shown in FIG. 4(*b*), a pressing member 8 is inserted into the preform 7 while evacuating the papermaking mold 1 through the interconnecting passageways 5 from the inside to the outside. The pressing member 8 is the same as used in the first aspect of the invention. This does not mean that the pressing member 8 to be used here should be of the same material, shape, etc. as those used in the first aspect. While, in the first aspect, the pressing member 8 is used for press drying the dewatered preform, the one used in the second aspect is for press dewatering the preform 7.

Prior to inserting the pressing member 8, a pressurizing fluid, such as compressed air, may be introduced into the cavity 4 while the slurry remains in the cavity 4 or while the diluent water, which has been fed to the cavity 4 in the final stage of preform 7 formation, remains in the cavity 4 thereby to expel the water content in the cavity 4 out of the mold. Where compressed air is blown, the blowing pressure and time can be the same as those used for compressed air that is used in the dewatering step according to the first aspect of the invention.

In the second aspect of the invention, the separable part 7*b* of the preform 7 has a laterally extending flange 7*c* similarly to the first aspect. Therefore, even if the pressing member 8 is inserted into the preform 7 while touching some part of the preform 7, it can be inserted into the preform 7 without causing deformation of, or damage to, the main part 7*a*. In particular, the preform 7 as obtained by papermaking is has a lower strength than the dewatered preform 7 because of its higher water content and is therefore easily deformed or damaged on a slight contact with the pressing member 8. Such deformation and damage can be prevented effectively by the flange 7*c*.

The pressing member 8 has a supporting member 10 inserted therein. The pressing member 8 and the supporting member 10 are inserted into the preform 7 while being fixed to the fixing part 9 as shown in FIG. 4(*b*). The details of the supporting member 10 and the fixing part 9 are the same as those in the first aspect of the invention.

When the pressing member 8 is inserted completely, the lower end of the pressing member 8 is positioned near the bottom of the preform 7. In this state, a prescribed pressurizing fluid is fed into the supporting member 10 from its source (not shown), i.e., a feeder of the pressurizing fluid, as shown in FIG. 4(*c*). Simultaneously with the pressurizing fluid feed, the splits 2 and 3 are evacuated from the outside. The pressing member 8 is thus expanded.

The water-containing preform 7 is pressed to the papermaking surface, i.e., the inner wall of the cavity 4, by the expanded pressing member 8. As a result, the preform 7 is press dewatered, and the inner shape of the cavity 4 is transferred to the preform 7. The fluid used to expand the pressing member 8 and the pressure of feeding the fluid are the same as those used in the first aspect of the invention.

After the preform 7 is dewatered to a prescribed water content, and the inner shape of the cavity 4 is sufficiently transferred to the preform 7, the fluid is withdrawn from the pressing member 8 to shrink the pressing member to its original size as shown in FIG. 4(*d*). The shrunken pressing member 8 and the supporting member 10 are taken out of the preform 7, and the papermaking mold 1 is opened to remove the preform 7 dewatered to the prescribed water content by means of a prescribed handling unit.

The preform taken out is subjected to the step of heat drying. The heat drying step is carried out in the same manner as in the first aspect of the invention. The dried preform is removed from the heating mold and cut at the recess, the joint between the separable part and the pulp molded article (main part), similarly to the first aspect of the invention.

The third aspect of the invention will now be described. The third aspect will be described only with regard to differences from the first and second ones. The detailed description about the first aspect appropriately applies to the particulars of the third aspect that are not described here.

In the third aspect of the invention, a preform having a prescribed shape is made by a prescribed wet papermaking process. The wet papermaking process includes not only the papermaking technique used in the first and the second aspects but other conventionally known papermaking processes. The shape of the preform is not particularly limited but is preferably close to the shape of a preform formed in the step of heat drying described later which is composed of a pulp molded main part and a separable part.

The preform formed by a wet papermaking process is subjected to a prescribed dewatering step. Dewatering can be carried out by an appropriate method including the dewatering method using a pressurizing fluid which is used in the first aspect, the press dewatering method using a pressing member which is used in the second aspect, and other conventionally known dewatering methods. By the dewatering step, the preform is dewatered to such a water content which makes the preform easy to handle.

The preform having a prescribed water content is then subjected to the step of heat drying. The heat drying step is performed by using a heating mold having a cavity whose shape corresponds to the contour of a preform of desired configuration which is composed of a main part and a separable part. The same heating mold as used in the first and the second aspects of the invention can be used, for example.

The preform having been dewatered to the prescribed water content is put into the cavity, and an expandable pressing member is inserted into the preform. A prescribed fluid is fed into the pressing member to expand the pressing member, and the preform is pressed toward the cavity wall by the expanded pressing member. The same pressing member and fluid used in the first and the second aspects can be used.

As a result of pressing the preform to the cavity wall by the pressing with the pressing member, the pressed preform is shaped into a preform composed of a main part with an opening and a flanged separable part connected to the edge of the opening while being dried by the heat. The configuration, such as the shape, of the flange can be the same as that in the first and the second aspects of the invention. Thereafter, the separable part and the main part are cut apart to obtain a pulp molded article as a final product.

The present invention is not limited to the above-described embodiments. For example, while the flange 7*c* of the separable part 7*b* in the aforementioned embodiments has the upright wall 7*d* on its periphery, the upright wall 7*d* may be omitted as far as the flange 7*c* exhibits a sufficient pulp fiber catching action. The flange 7*c*, which extends horizontally, may be tapered to have an upward slope to the periphery.

The flange 7*c* may be discontinuous as long as a sufficient pulp fiber catching action is exerted.

In the drying step, a pressing member to be used may have a larger size than the opening of the preform in order to improve durability of the pressing member against repeated use. In this case, too, the pulp molded article can be prevented from deformation or damage even if the pressing member touches the flange because the preform having been dewatered to the prescribed water content has high strength. As a result, the step of shrinking the pressing member prior to the insertion into the preform can be omitted, which leads to a reduction of time required for mechanical operation.

While the papermaking mold 1 used in the aforementioned embodiments is made up of a pair of pieces 2 and 3, it may be composed of three or more split pieces in accordance with the shape of the molded article. The same applies to the heating mold.

While the papermaking mold and the drying mold used in the above embodiments have a continuous annular ridge 11, the ridge 11 may be discontinuous. In this case, the recess 13 corresponding to the ridge 11 which is formed on the preform is also discontinuous.

The particulars of the above-described embodiments are appropriately interchangeable with each other.

The production methods according to the present invention are particularly effective for the manufacture of bottle-shaped molded articles. They are applicable as well to the manufacture of cartons, cushioning materials, and molded articles of other shapes. They are applicable to the manufacture of not only containers for holding contents but molded articles of various shapes as freely designed, such as ornaments.

INDUSTRIAL APPLICABILITY

According to the methods of producing a pulp molded article according to the present invention, a pulp molded article can be produced stably because a water-containing preform can be press dewatered or press heated without being deformed or damaged.

In carrying out multilayer papermaking, a pulp molded article having a multilayered structure can be formed stably to attain an increased yield.

According to the methods of the invention, a pulp molded preform has improved handling properties in the production steps.

What is claimed is:

1. A method of producing a pulp molded article comprising:

feeding a pulp slurry to a cavity of a papermaking mold having a prescribed cavity shape to form a pulp preform on a papermaking surface of said cavity such that said preform comprises a main part having an open neck and a body with a diameter greater than a diameter of said open neck and a separable part having a flange and connected to an edge of said open neck;

inserting an expandable pressing member into said preform from a side of said separable part;

feeding a prescribed fluid into said pressing member to expand said pressing member thereby to press said preform toward said papermaking surface by the expanded pressing member;

removing said preform from said papermaking mold; and then cutting said preform at a joint between said separable part and said main part.

2. The method of producing a pulp molded article according to claim 1, wherein said pressing member has a supporting member inserted therein with a prescribed part of said pressing member being fixed to a prescribed part of said supporting member, and said pressing member is inserted into said preform while being supported by said supporting member.

3. The method of producing a pulp molded article according to claim 1, wherein said preform is formed such that said main part assumes a shape of a bottle having an open neck, a body, and a bottom.

4. The method of producing a pulp molded article according to claim 1, wherein the preform is formed such that said separable part has an upright wall standing from a periphery of said flange.

5. An apparatus for carrying out the method of producing a pulp molded article according to claim 1 comprising:

a papermaking mold having a cavity of a prescribed shape;

means for feeding a pulp slurry to said cavity;

an expandable pressing member configured to be inserted into a pulp preform formed in said cavity;

means for feeding a prescribed fluid into said pressing member;

means for removing said preform from said papermaking mold; and means for cutting said preform at a joint between said separable part and said main part;

and wherein said cavity of said papermaking mold is configured so that said cavity is in conformity to a contour of said pulp preform comprising a main part having an open neck and a body with a diameter greater than a diameter of said open neck and a separable part having a flange and connected to an edge of the said open neck.

6. The apparatus for producing a pulp molded article according to claim 5, wherein said cavity of said papermaking mold is configured so that said separable part has an upright wall standing from a periphery of said flange.

7. An apparatus for carrying out the method of producing a pulp molded article according to claim 4 comprising:

a heating mold having a cavity of a prescribed shape;

means for putting a pulp preform formed by a wet papermaking process into said heating mold;

an expandable pressing member configured to be inserted into said preform;

means for inserting said pressing member;

means for feeding a prescribed fluid into said pressing member;

means for removing said preform from said heating mold; and means for cutting said preform at a joint between said separable part and said main part, and wherein said cavity of said heating mold is configured so that said cavity is in conformity to a contour of said pulp preform comprising a main part having an open neck and a body with a diameter greater than a diameter of said open neck and a separable part having a flange and connected to an edge of the said open neck.

8. The apparatus for producing a pulp molded article according to claim 7, further comprising:

a papermaking mold having a cavity of a prescribed shape;

means for feeding a pulp slurry to said cavity; and means for feeding a pressurizing fluid to said preform formed in said cavity.

9. The apparatus for producing a pulp molded article according to claim 8, is wherein said cavity of said papermaking mold is configured so that said separable part has an upright wall standing from a periphery of said flange.

10. A method of producing a pulp molded article comprising:

feeding a pulp slurry to a cavity of a papermaking mold having a prescribed cavity shape to form a pulp preform on a papermaking surface of said cavity such that said preform comprises a main part having an open neck and a body with a diameter greater than a diameter of said open neck and a separable part having a flange and connected to an edge of said open neck;

feeding a pressurizing fluid into said preform to dewater said preform;

removing said preform from said papermaking mold;

putting said preform into a cavity of a heating mold having a prescribed cavity shape;

inserting an expandable pressing member into said preform from a side of said separable part;

feeding a prescribed fluid into said pressing member to expand said pressing member thereby to dry said preform while pressing said preform by the expanded pressing member toward said papermaking surface;

removing the dried preform from said heating mold; and then cutting said preform at a joint between said separable part and said main part.

11. A method of producing a pulp molded article comprising:

forming a preform having a prescribed shape by a wet papermaking process;

putting said preform into a cavity of a heating mold having a prescribed cavity shape;

inserting an expandable pressing member into said preform;

feeding a prescribed fluid into said pressing member to expand said pressing member thereby to press said preform by the expanded preform toward a surface of said cavity to shape said preform into a main part having an open neck and a body with a diameter greater than a diameter of said open neck and a separable part having a flange and connected to an edge of said open neck;

removing a resulting preform comprising said main part and said separable part from said heating mold; and then cutting said preform at a joint between said separable part and said main part, and wherein said pressing member is inserted into said preform from a side of said separable part.

* * * * *